US009675172B2

(12) United States Patent
Pandorf et al.

(10) Patent No.: US 9,675,172 B2
(45) Date of Patent: Jun. 13, 2017

(54) MEDICINE CABINET

(75) Inventors: Robert P. Pandorf, Yardley, PA (US); Douglas J. Diemel, Philadelphia, PA (US); Howard S. Katz, Riegelsville, PA (US)

(73) Assignee: ROBERN, INC., Bristol, PA (US)

( * ) Notice: Subject to any disclaimer, the term of this patent is extended or adjusted under 35 U.S.C. 154(b) by 1110 days.

(21) Appl. No.: 12/428,827

(22) Filed: Apr. 23, 2009

(65) Prior Publication Data

US 2010/0270438 A1 Oct. 28, 2010

(51) Int. Cl.
*A47B 67/02* (2006.01)

(52) U.S. Cl.
CPC ..... *A47B 67/02* (2013.01)

(58) Field of Classification Search
CPC ..... A47B 67/00; A47B 67/02; A47B 67/005; A47B 21/06; A47B 2067/025; A47B 81/00; H02B 1/305; H05K 5/0247
USPC .... 312/209, 242, 245, 349, 139.2, 227, 301, 312/223.6
See application file for complete search history.

(56) References Cited

U.S. PATENT DOCUMENTS

| | | | | |
|---|---|---|---|---|
| 744,485 | A | 11/1903 | Cate | |
| 878,255 | A | 2/1908 | Thompson | |
| 1,618,158 | A | 2/1927 | Horwitz | |
| 2,120,327 | A * | 6/1938 | Elsaesser | 312/296 |
| 2,331,655 | A | 10/1943 | Colwill et al. | |
| 2,480,383 | A | 8/1949 | Pino | |
| 2,582,812 | A * | 1/1952 | Wise | 312/242 |
| 2,628,832 | A * | 2/1953 | Houlis | 49/361 |
| 2,701,896 | A * | 2/1955 | Fritz | 49/225 |
| 2,773,728 | A | 12/1956 | Barre | |
| 2,882,114 | A * | 4/1959 | Sease et al. | 312/279 |
| 2,953,108 | A * | 9/1960 | Kelsen | 110/173 R |
| 3,018,690 | A | 1/1962 | Magrauth | |
| 3,328,105 | A * | 6/1967 | Trulaske | 49/445 |
| 3,377,756 | A * | 4/1968 | Polhamus | 52/220.7 |
| 3,521,936 | A * | 7/1970 | Coker, Jr. | 312/209 |
| 4,094,561 | A | 6/1978 | Wolff et al. | |
| 4,372,629 | A * | 2/1983 | Propst et al. | 312/223.6 |
| 4,535,703 | A * | 8/1985 | Henriott et al. | 108/50.02 |
| 4,826,112 | A | 5/1989 | Rettler | |
| 5,022,720 | A | 6/1991 | Fevig et al. | |
| 5,355,627 | A | 10/1994 | Katz | |
| 5,577,819 | A * | 11/1996 | Olsen | 312/242 |

(Continued)

FOREIGN PATENT DOCUMENTS

| | | |
|---|---|---|
| CN | 1511488 | 7/2004 |
| DE | 3510670 | 9/1986 |

(Continued)

OTHER PUBLICATIONS 13 pages of an PCT search report dated Aug. 6, 2010 in the corresponding PCT US2010/031853 application.

(Continued)

*Primary Examiner* — Patrick Hawn
(74) *Attorney, Agent, or Firm* — Foley & Lardner LLP

(57) ABSTRACT

A medicine cabinet is disclosed that has electrical power. An internal raceway is provided to hide the electrical wiring for the cabinet, accommodate power cords of appliances powered by the cabinet, and to support shelving. A vertically movable front mirrored door can be raised to access the power supply and/or cabinet storage space.

22 Claims, 6 Drawing Sheets

(56) References Cited

U.S. PATENT DOCUMENTS

| | | | | |
|---|---|---|---|---|
| 5,994,644 | A * | 11/1999 | Rindoks et al. | 174/495 |
| 6,135,583 | A * | 10/2000 | Simon et al. | 312/257.1 |
| 6,349,655 | B1 * | 2/2002 | Carr et al. | 108/50.02 |
| 6,565,166 | B1 * | 5/2003 | Bulk et al. | 312/257.1 |
| 2002/0113532 | A1 * | 8/2002 | Hornberger et al. | 312/323 |
| 2003/0042828 | A1 * | 3/2003 | Bonin | 312/245 |
| 2003/0127027 | A1 * | 7/2003 | Gutgsell et al. | 108/50.02 |
| 2007/0120451 | A1 * | 5/2007 | Lamar | 312/227 |
| 2007/0241259 | A1 * | 10/2007 | Pandorf et al. | 250/214 AL |
| 2008/0169251 | A1 * | 7/2008 | Smith | 211/26 |

FOREIGN PATENT DOCUMENTS

| | | |
|---|---|---|
| DE | 202005003810 | 7/2006 |
| JP | 2008136736 | 6/2008 |

OTHER PUBLICATIONS

Notice of First Office Action re: App. No. 201510580319.0 (9 pgs).

* cited by examiner 52
58
60
56
50
54
6
48
44
52
92
112
52
92
46
6

MEDICINE CABINET

CROSS-REFERENCES TO RELATED APPLICATIONS

Not Applicable.

STATEMENT REGARDING FEDERALLY SPONSORED RESEARCH

Not Applicable.

BACKGROUND OF THE INVENTION

The present invention relates to storage cabinets such as medicine cabinets. More particularly it relates to improvements in positioning and storing electrical wiring for these cabinets, and power cords for appliances and other items stored in the cabinet.

It is conventional to provide wall-hung "medicine" cabinets in homes that are used to store cosmetics, drugs, and other personal items. Some of these cabinets are provided with electrical power (e.g. to light the cabinet itself and/or to provide a plug-in site for personal care devices such as hair dryers, curling irons, toothbrushes and shavers). See generally U.S. Pat. No. 5,355,627.

Most such cabinets have their front door pivot open on a vertical hinge. However, some provide a front door that slides vertically. See e.g. U.S. Pat. No. 2,331,655.

Regardless, the structures used to house the needed electrical wiring for electrified medicine cabinets were not optimal. For example, when a pivoting front door was provided, and the door was open, the mirror on the front of the door was no longer easily usable. Hence, an electrical plug-in outlet associated with such a cabinet would therefore typically be placed on the exterior of the cabinet. This is not only somewhat ugly, it exposes the outlet to an environment where water is more likely to be present.

Further, placing the outlet at some locations in such a cabinet could interfere with storage capability in an undesirable way. In any event, typical medicine cabinets were not well suited for dealing with elongated power cords associated with some consumer appliances that were not in use.

Accordingly, there exists a need for improving such storage cabinets in addressing these concerns.

SUMMARY OF THE INVENTION

In accordance with one aspect of the present invention, there is provided a storage cabinet (e.g. a medicine cabinet). It has an outer housing having opposed side walls, an openable front door, and an internal storage cavity between the opposed side walls. There is also a vertically extending wire management raceway positioned between the opposed side walls so as to define storage sections in the cavity on opposite lateral sides of the wire management raceway. The wire management raceway has an internal passage that houses electrical wiring.

In one form the electrical wiring is linkable to an external power source (e.g. a building power supply), and another end of the electrical wiring is linked to an electric outlet (e.g. most preferably positioned on an outer face of the wire management raceway).

In another form there is an elongated pocket formed along the wire management raceway and accessible from an exterior of the wire management raceway, the pocket is suitable to conceal a portion of a power cord of an item (e.g. a curling iron) stored in the internal storage cavity when the item is not linked to a power supply. For example, the outer housing can have a rear wall and the pocket can be located adjacent a junction between the rear wall and the wire management raceway.

In one form the pocket is associated with a flexible retainer suitable to assist in retaining such a power cord in the pocket if positioned therein, where the retainer is in a form of a flexible brush, gasket or bulb style seal.

The wire management raceway can also have an array of means (e.g. holes or pegs) for supporting a shelf at selected heights in the internal storage cavity, and a shelf is at least partially supported thereon in the internal storage cavity.

In the most preferred form the door is openable by a vertical sliding movement, and its movement is in part governed by a counterweight.

It should be appreciated that the outlet can be positioned low enough along the raceway such that moving the door up slightly exposes the outlet, permitting a shaver or other electrical item to be powered from the outlet while a mirror on the front of the door is still useful.

Note also that when the accessories like a shaver are not in use, they can be stored on shelving of the cabinet with their cord properly concealed in a pocket. Hence, such items do not need to be crammed in a drawer due to their unwieldy power cords.

Also consider that there are some items that can be permanently positioned inside the medicine cabinet (e.g. a recharging base for a rechargeable toothbrush). Such an item might be "permanently" plugged into an upper outlet of the cabinet, leaving one or more lower outlets free for use by items such as a hairdryer. Thus, rather than using the outlet 52 as shown in FIG. 5, the recharging base could use a very high outlet 52 near the top of the raceway.

Similarly, a television associated with the medicine cabinet (e.g. visible through the mirror on the front door) could be permanently plugged into an outlet along the raceway, such as an upper outlet. The raceway would then provide a permanent benefit with respect to cord management.

Thus, the raceway permits power to be supplied at optimal positions from a vertical standpoint.

Moreover, the raceway allows removable shelves to be positioned as needed.

The foregoing and other advantages of the present invention will become apparent from the following description. In that description reference will be made to the accompanying drawings which form a part thereof, and in which there is shown by way of illustration an example embodiment of the invention. However, the example embodiment is not intended as a representation of the full scope of the invention. Rather, the claims should be looked to for that purpose.

DETAILED DESCRIPTION OF THE INVENTION

Figure 1:
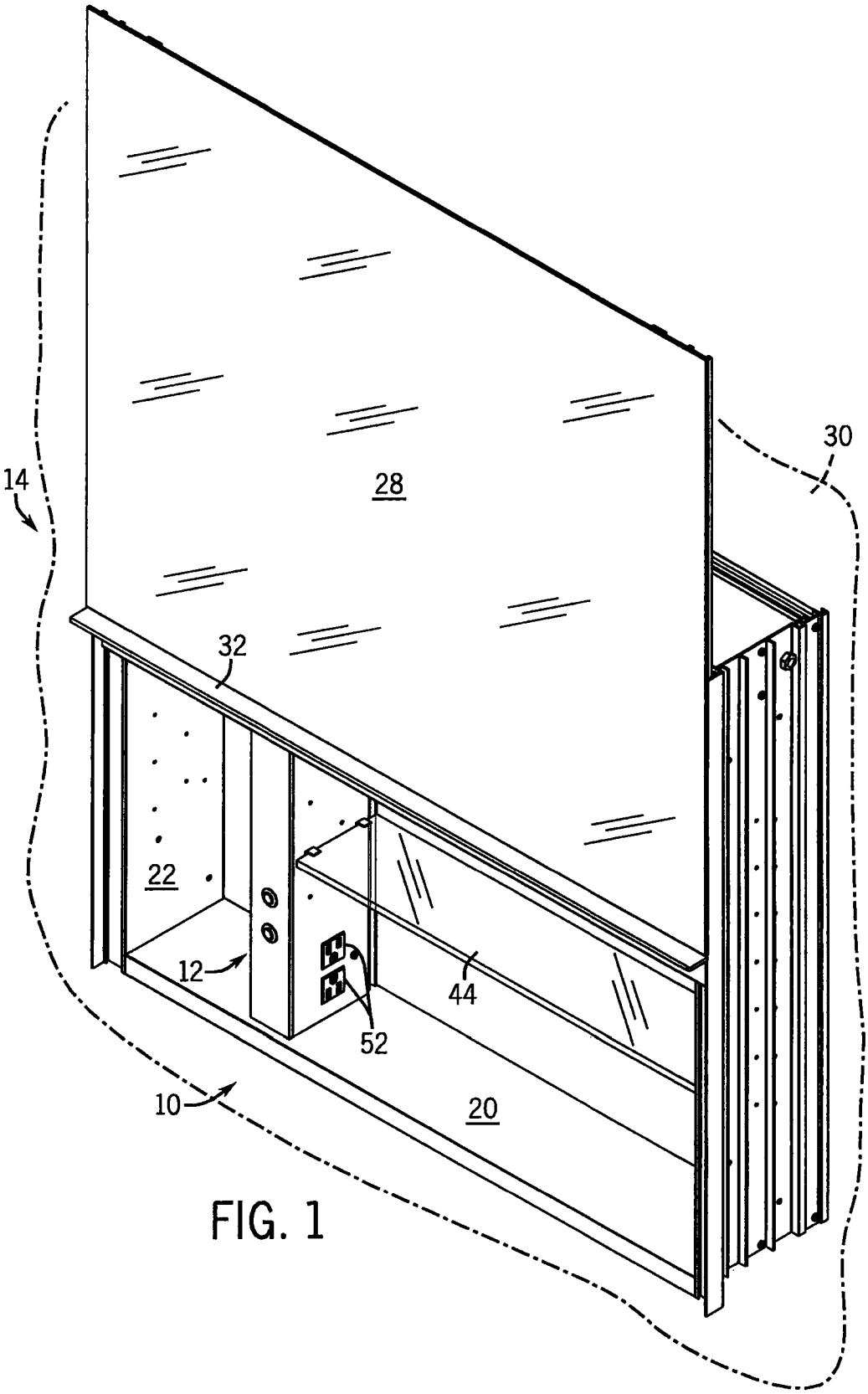
FIG. 1 is a perspective view of a medicine cabinet of the present invention, with its front door shown partially raised.

A preferred assembly, generally 10, is shown in the drawings. There is shown a medicine cabinet 14 having a top wall 18, a bottom wall 20, opposed side walls 22, and preferably a rear wall 24, which together define an internal cavity. Dividing the cavity is a wire management raceway generally 12. There is also a front door 28 (preferably mirrored and vertically slidable). For example the door 28 can have a horizontally extending handle 32 fixed along a lower edge 34 thereof to facilitate lifting and lowering of the door 28. There can also be a counterweight 36 (equal to the weight of the door 28).

The door 28 is slidably retained within a set of vertical tracks 38 formed along the side walls 22 of the enclosure 16. The door 28 is connected to the counterweight 36 via a pair of toothed belts 40 extending over a roller 41 and respective gear wheels 42. The belts 40 engage and cooperate with the wheels 42 when lifting or lowering the door 28. Door 28 may be maintained in a partially opened position such as shown in FIG. 1.

The cabinet is suitable to be mounted onto a vertical wall 30 using brackets or other conventional means. Also, while the principles of the present invention are mostly intended for use in a medicine cabinet, it should be appreciated that they will also be valuable in the context of other cabinets such as kitchen cupboards, and personal workstations.

Pegs can be positioned in various holes along the side walls 22 and raceway 12. Shelving 44 can be positioned thereon at desired vertical heights.

Health and beauty aids such as cosmetics, toiletries, and the like may be conveniently stored on the shelves 44. Further, electric grooming devices 46 may be stored in a cabinet when not in use.

Figure 5:
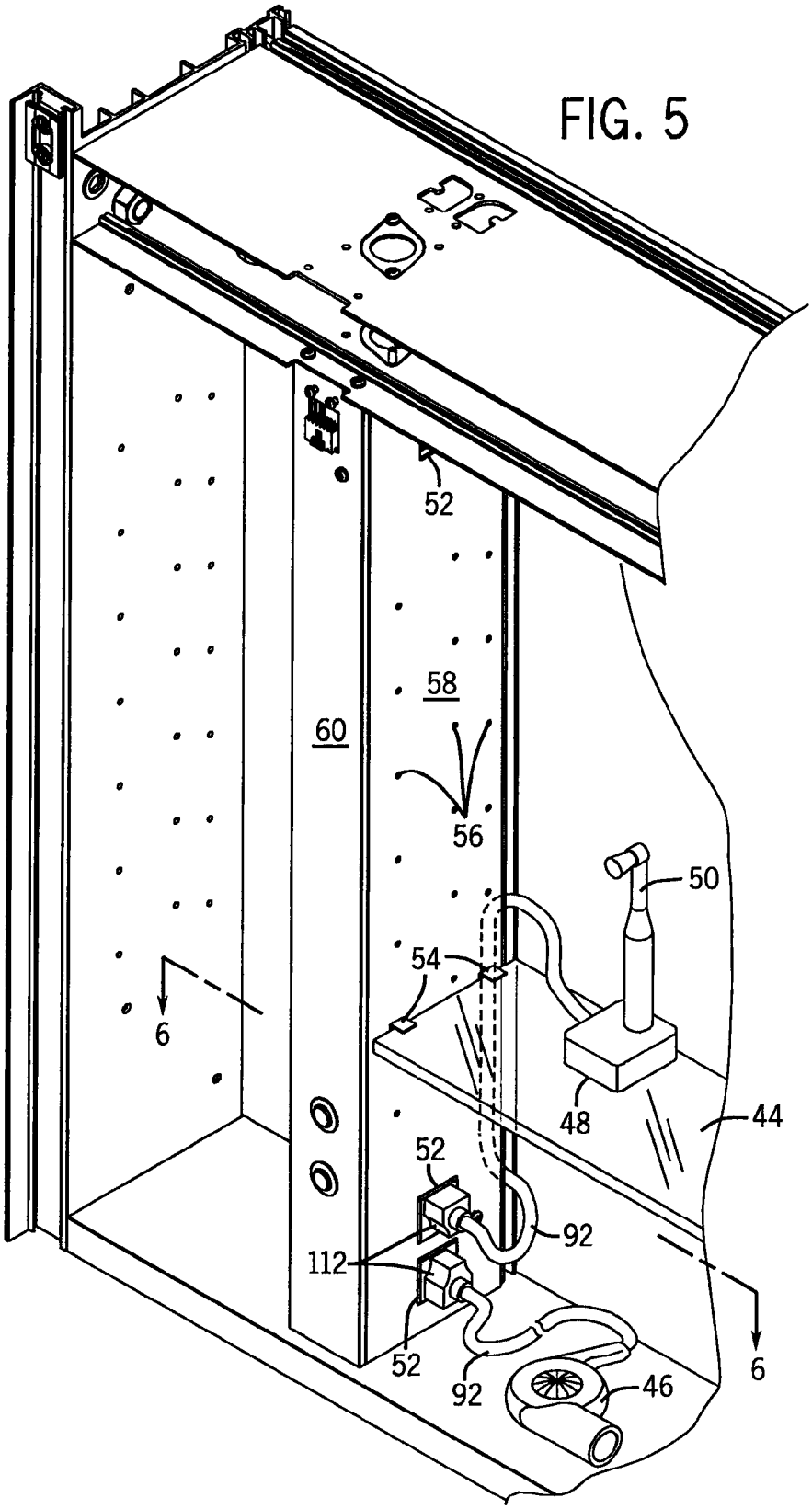
FIG. 5 is a detailed perspective view of a portion of the medicine cabinet of FIG. 1, illustrating how certain personal care devices can be linked to the raceway.

Note also a recharging base 48 positioned on a shelf 44 in FIG. 5 with its power cord managed by being partially concealed in a pocket defined by raceway 12, with the opposite end of its power cord linked into an outlet 52. Hence, a toothbrush 50 can be recharged without the consumer needing to keep the recharging device on a counter top or the like. Also, as previously noted, the toothbrush recharging base can be permanently plugged in at an outlet 52 near the top of the raceway, to leave the lower outlets free for other purposes.

As indicated, outlets 52 can be at varied vertical heights, albeit placing them close to the bottom of the raceway 12 makes it easier to use a power outlet as well as a mirror on the front door 28 simultaneously.

Figure 3:
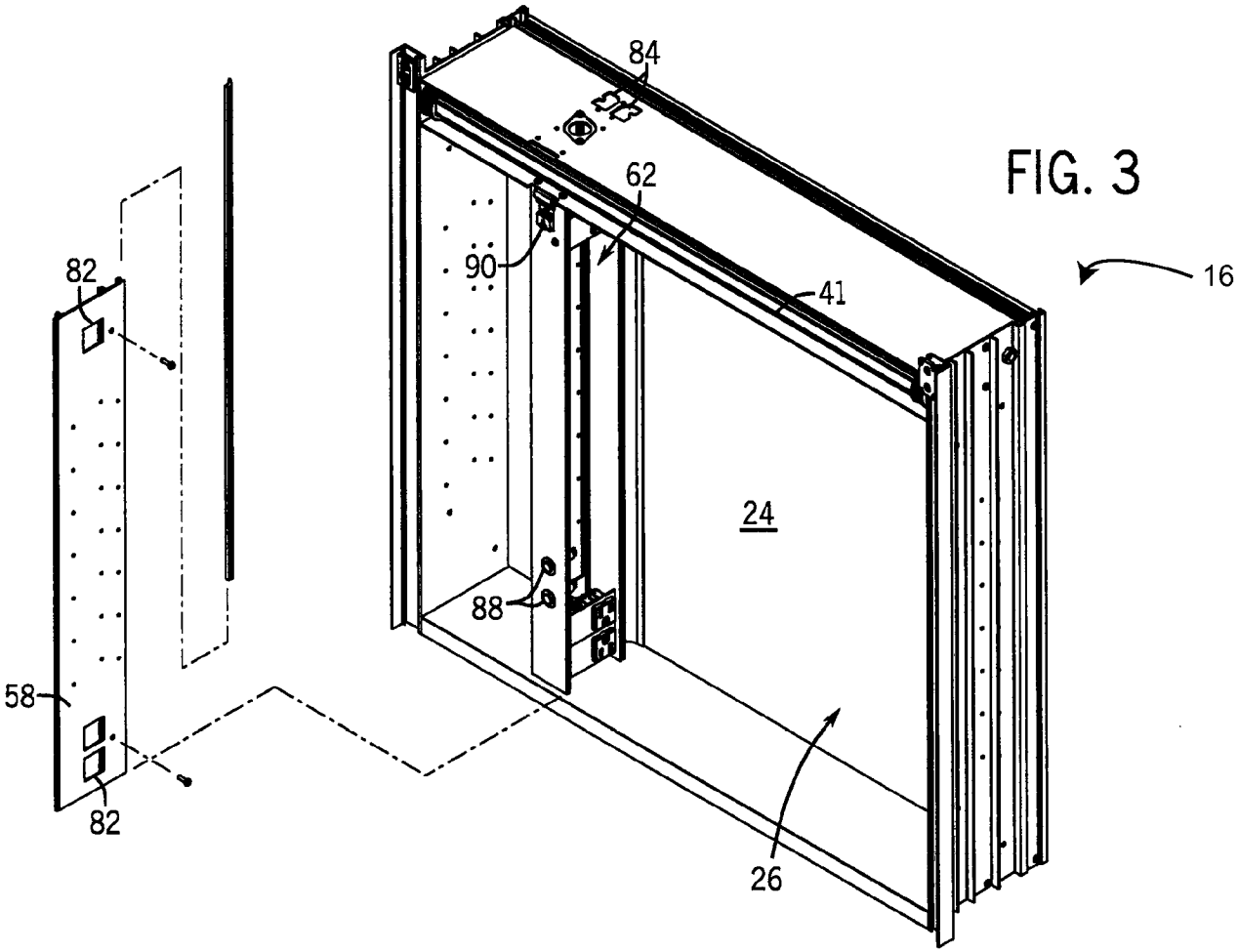
FIG. 3 is a partially exploded frontal perspective view of certain structural internal components of the cabinet of FIG. 1.
Figure 4:
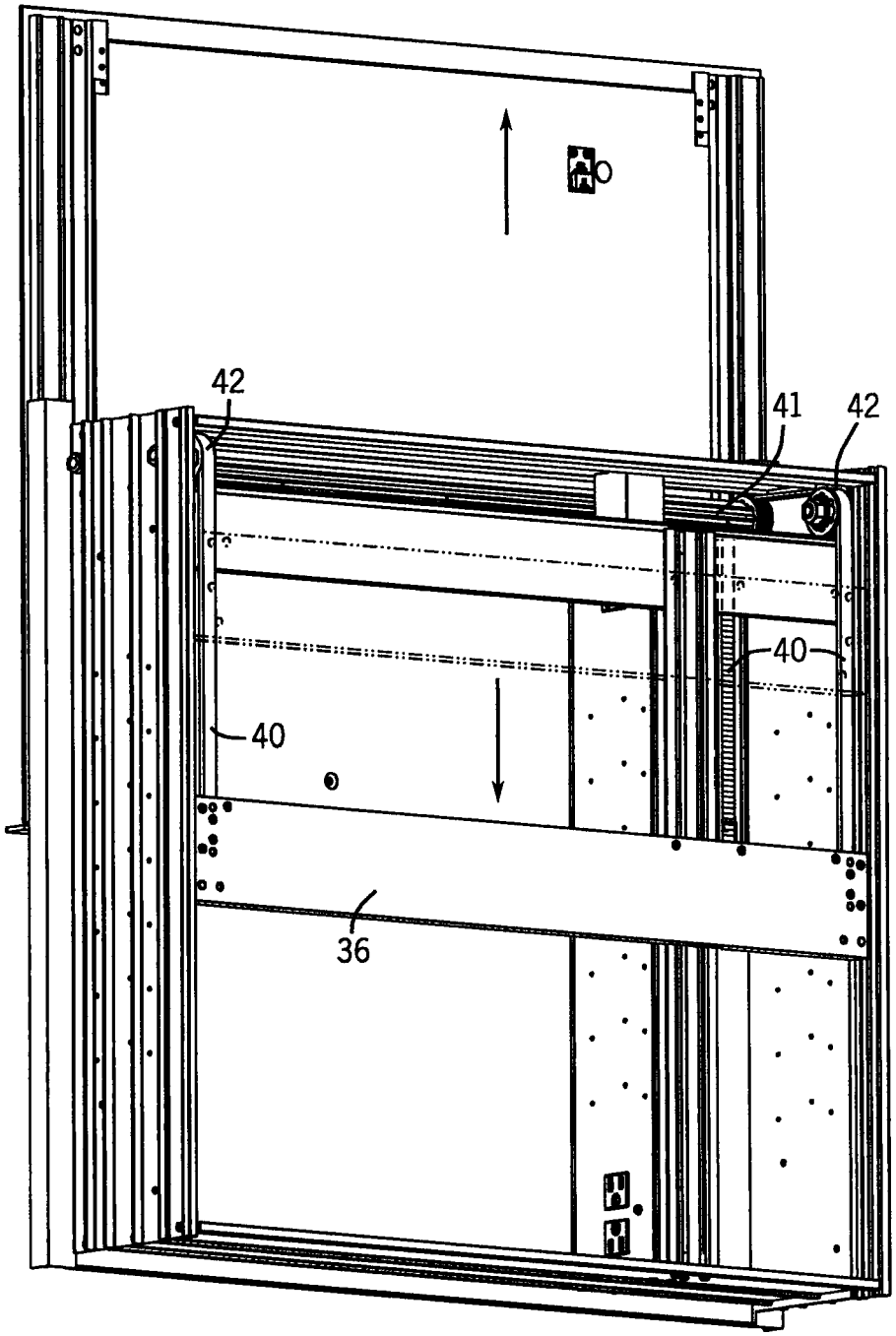
FIG. 4 is a rear perspective view of the cabinet of FIG. 1, depicting in part an associated counterweight system.

As shown in FIG. 3, the raceway 12 can be a largely unitary structure. It can have spaced apart side walls 58 and a planar front wall 60 defining a generally U-shaped passage 62 therein. When the raceway 12 is secured within the cabinet 14, the outer housing of the cabinet together therewith create a passage 62 for electrical wiring, such that electrical wiring 64 and related electrical connections are isolated from the opposed lateral storage areas 26, helping to achieve compliance with various electrical wiring safety codes.

Figure 6:
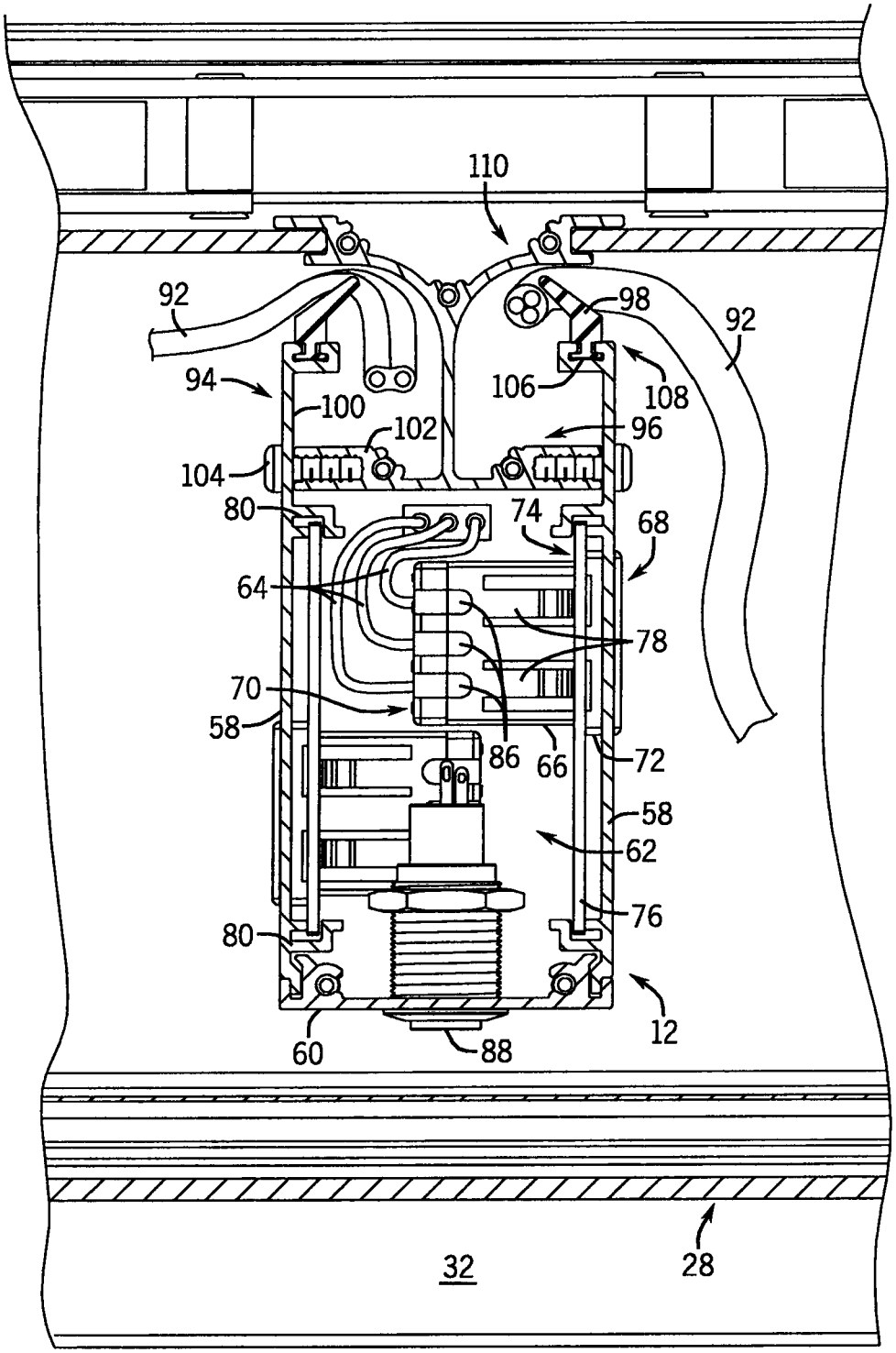
FIG. 6 is a cross-sectional view taken along line 6-6 of FIG. 5.

Referring next also to FIG. 6, each outlet 52 is formed with a substantially square housing 66 having a front end 68, a rear end 70, and a radial flange 72 adjacent to the front end 68. During assembly of the raceway 12, the outlet 52 is inserted through aligned square-shaped openings 82, 74 formed in the side wall 58 and a retaining plate 76 therein. The retaining plate 76 is secured within a pair of spaced apart slotted protrusions 80 formed inside the passage 62.

A plurality of retaining clips 78 in the housing 66 are temporarily inwardly displaced when the outlet 52 is pushed further through the opening 74 in the retaining plate 76. The outlet 52 is fully inserted when the flange 72 abuts the retaining plate 76, allowing the clips 78 to return to their unbiased position. In such a position, the clips 78 firmly press against the retaining plate 76 to hold the outlet 52 in place. When installed, the front end 68 of the outlet 52 extends slightly through the opening 82 in the side wall 58 and presents an aesthetically pleasing appearance.

Figure 2:
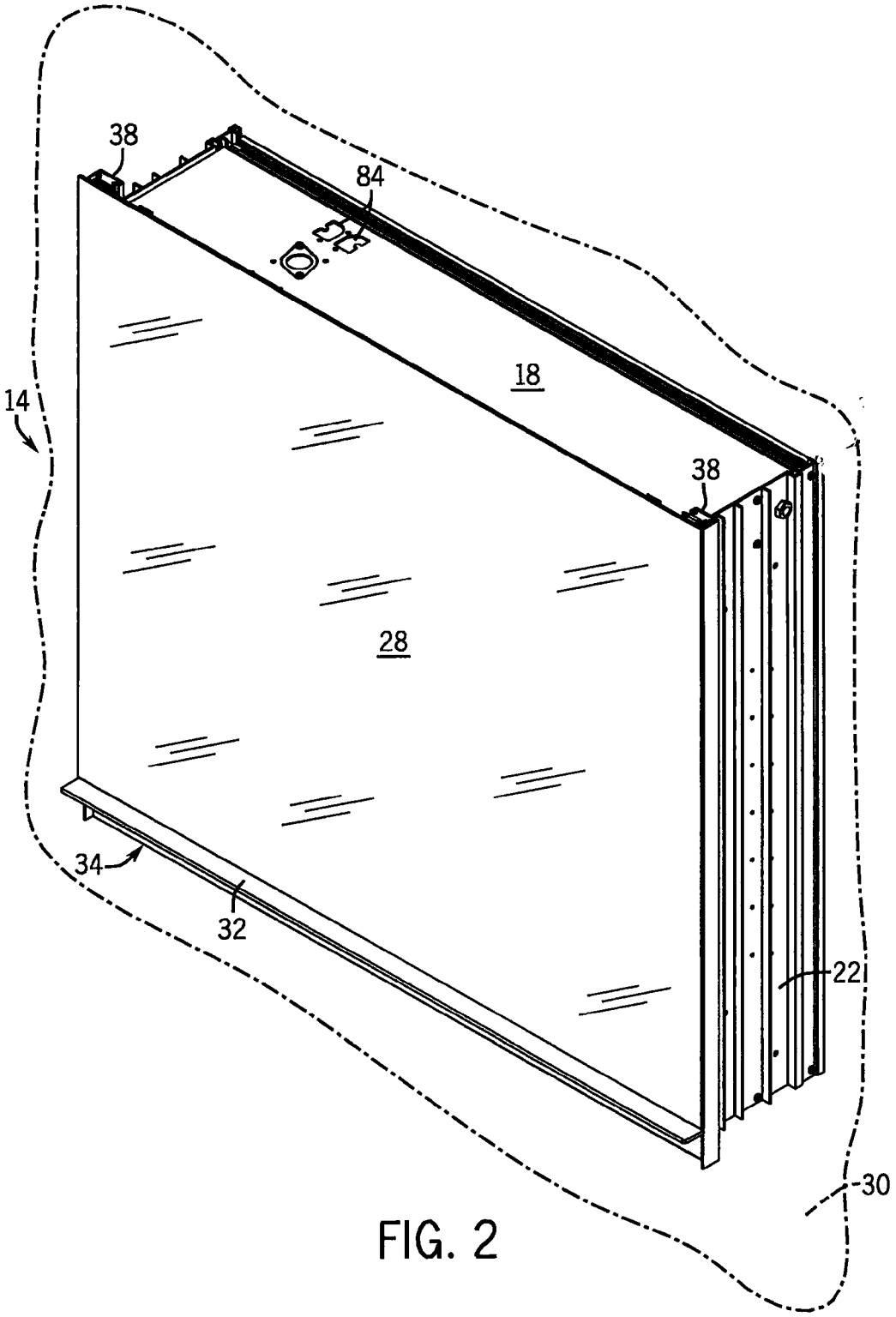
FIG. 2 is a view similar to FIG. 1, but with the front door fully closed.

As shown in FIG. 2, one or more openings 84 may be provided in the top or bottom walls 18, 20 to permit entry of wiring from a building power supply (not shown) into the raceway 12. Note also terminals 86 provided at the rear end 70 of the outlet 52. The cabinet may be wired to a GFI circuit breaker, if desired. Low profile push buttons or switches 88 may be provided on the front wall 60 of the raceway 12 to control a light 90 and/or one or more of the outlets 52.

It should be appreciated that standard power cords 92 supplying power to the devices like a television monitor or recharging base may be very long. Rather than having those cords be repeatedly wound around themselves, and/or otherwise take up internal storage space, provision is made to manage those cords. Specifically, each side wall 58 of the raceway 12 is provided near its rear with a pocket 94 in the form of an elongated channel 96 that is open externally. There is also a flexible retainer 98 (see FIG. 6) which helps hold the cord in the pocket once placed therein.

The channel 96 may be integrally formed in the side walls 58 such as with a one-piece extrusion process, or, as illustrated, be formed by two extruded pieces 100, 102 fastened together with screws 104. Regardless of the manufacture process, the cross-sectional area of the channel 96 is large enough to accommodate one or more power cords 92.

The retainer 98 may be made of a resilient material such as foam, rubber, or a brush strip capable of at least partially concealing the channel 96 and retaining power cords 92 placed therein. The retainer 98 is secured to the side wall 58 via frictional engagement with a slot 106 formed on one edge 108 of the channel 96. Alternatively, a suitable adhesive or heat welding may be used. The retainer 98 is inwardly angled and tapered and extends towards the other edge 110 of the channel 96.

Parts of one or more power cords 92 may be pushed/tucked into the pocket 94 with a pressing force sufficient to temporarily displace the retainer 98. This may be when an item is not in use, or in the case of something like a recharging station when the full length of a power cord isn't needed.

Referring particularly to FIG. 5, it can be seen that an associated plug 112 may be plugged into an outlet with unneeded cord length 92 retained within the pocket 94. Note that there may also be horizontal wireways in the shelves 44 or bottom wall 20 to conceal and retain the power cords 92 to a further extent.

What has been described thus far is merely a preferred embodiment of the invention. It should be appreciated that various other modifications could be made without departing from the spirit and scope of the invention. Thus, the claims should be looked to in order to judge the full scope of the invention.

INDUSTRIAL APPLICABILITY

The present invention provides storage cabinets such as medicine cabinets with improved structures for accommodating electrical wiring for the cabinets, and power cords for appliances used therewith.

What is claimed is:

1. A storage cabinet, comprising:

an outer housing having opposed side walls, an openable front door, and an internal storage cavity between the opposed side walls;

a vertically extending wire management raceway positioned between the opposed side walls so as to define storage sections in the cavity on opposite lateral sides of the wire management raceway, wherein the wire management raceway has an internal passage that houses electrical wiring;

a single counterweight that is configured to move when the door moves;

a single roller;

a first belt that extends over the single roller and is coupled to the single counterweight at a first location; and a second belt that extends over the single roller and is coupled to the single counterweight at a second location;

wherein one end of the electrical wiring is linkable to an external power source, and another end of the electrical wiring is linked to an electric outlet positioned on an outer face of the wire management raceway;

wherein the door is openable by a vertical sliding movement and includes a mirror, the door configured to slide upward in a generally vertical plane; and wherein the movement of the door is governed at least in part by the single counterweight.

2. The storage cabinet of claim 1, further comprising a pocket formed on the wire management raceway and accessible from an exterior of the wire management raceway, the pocket being suitable to conceal a portion of a power cord of an item stored in the internal storage cavity when the item is not linked to a power supply.

3. The storage cabinet of claim 2, wherein the outer housing further comprises a rear wall and the pocket is located adjacent a junction between the rear wall and the wire management raceway.

4. The storage cabinet of claim 2, wherein the pocket is associated with a flexible retainer suitable to assist in retaining such a power cord in the pocket if positioned therein.

5. A storage cabinet comprising:

a plurality of walls defining cavity; a pair of opposed vertical tracks coupled to the plurality of walls; a door slidably retained with the pair of opposed vertical tracks, having;

a mirrored surface and configured to slide upward in a vertical plane to open the cavity and downward in the vertical plane to close the cavity;

an electrical outlet accessible from within the cavity when the cavity is at least partially opened; a single roller; and a single counterweight that extends between two opposed walls of the plurality of walls, wherein the counterweight slides relative to the door and the two opposed walls to influence sliding of the door, wherein the counterweight slides upward as the door slides downward, and the counterweight slides downward as the door slides upward;

wherein the mirrored surface faces a constant direction as the door is slid in the vertical plane.

6. The storage cabinet of claim 1, wherein the single roller extends laterally between the opposing side walls of the housing, and wherein the single counterweight and the door weigh approximately the same.

7. The storage cabinet of claim 6, further comprising:

a first wheel rotatably coupled to a first side wall of the opposed side walls, wherein the first belt extends over the first wheel; and a second wheel rotatably coupled to a second side wall of the opposed side walls, wherein the second belt extends over the second wheel.

8. The storage cabinet of claim 7, wherein the first location is proximate the first side wall and the second location is proximate the second side wall, and wherein the front door is slidably retained within two vertical tracks.

9. The storage cabinet of claim 8, wherein each of the vertical tracks is coupled to one of the opposed side walls.

10. The storage cabinet of claim 5, further comprising:

a first belt that extends over the single roller and is coupled to the single counterweight at a first location; and a second belt that extends over the single roller and is coupled to the single counterweight at a second location.

11. The storage cabinet of claim 10, further comprising a vertically extending wire management raceway positioned within the cavity so as to define storage sections in the cavity on opposite lateral sides of the wire management raceway, wherein the wire management raceway has an internal passage that houses electrical wiring.

12. The storage cabinet of claim 11, wherein one end of the electrical wiring is linkable to an external power source, and another end of the electrical wiring is linked to the electric outlet.

13. The storage cabinet of claim 11, wherein the electrical outlet is positioned on an outer face of the wire management raceway.

14. The storage cabinet of claim 11, further comprising a pocket formed on the wire management raceway and accessible from an exterior of the wire management raceway, the pocket being suitable to conceal a portion of a power cord of an item stored in the cavity when the item is not linked to a power supply.

15. The storage cabinet of claim 14, wherein the pocket is associated with a flexible retainer suitable to assist in retaining such a power cord in the pocket if positioned therein.

16. The storage cabinet of claim 5, wherein the door is configured to maintain a static position in which the cavity is partially opened.

17. The storage cabinet of claim 5, wherein the electrical outlet is position proximate a bottom of the cavity.

18. A storage cabinet comprising:

a plurality of walls defining a cavity;

a door having a mirrored surface and configured to slide upward in a vertical plane to open the cavity and downward in the vertical plane to close the cavity;

an electrical outlet accessible from within the cavity when the cavity is at least partially opened;

a single counterweight that extends between two opposed walls of the plurality of walls and is movable relative to the two opposed walls to influence sliding of the door;

a single roller extending between the two opposed walls; and a pair of belts extending over the single roller and coupled to the single counterweight;

wherein the mirrored surface faces a constant direction as the door is slid in the vertical plane.

19. The storage cabinet of claim 18, wherein the counterweight and the door weigh approximately the same.

20. The storage cabinet of claim 18, wherein the pair of belts comprises:

a first belt extending over the single roller and a first wheel; and a second belt extending over the single roller and a second wheel.

21. The storage cabinet of claim 20, wherein the first belt is coupled to a first end of the single counterweight and the second belt is coupled to a second end of the single counterweight.

22. The storage cabinet of claim 21, wherein each of the belts is toothed and extends over a gear wheel.

* * * * *